US005755468A

United States Patent [19]

Buchanan, Jr.

[11] Patent Number: 5,755,468

[45] Date of Patent: May 26, 1998

[54] POWER STRIKER WITH OVER-RIDE CAPABILITIES

[75] Inventor: Harry C. Buchanan, Jr., Spring Valley, Ohio

[73] Assignee: ITT Automotive Electrical Systems, Inc., Auburn Hills, Mich.

[21] Appl. No.: 642,781

[22] Filed: May 3, 1996

[51] Int. Cl.[6] ..... E05B 15/02

[52] U.S. Cl. ..... 292/341.16; 292/DIG. 46

[58] Field of Search ..... 292/340, 341.16, 292/341.15, 341.18, DIG. 23, 341.17, DIG. 43, DIG. 46

[56] References Cited

U.S. PATENT DOCUMENTS

| | | | |
|---|---|---|---|
| 2,903,288 | 9/1959 | Joachim et al. . | |
| 2,916,319 | 12/1959 | Du Bois | 292/341.16 |
| 3,047,326 | 7/1962 | Leslie et al. | 292/341.15 |
| 3,056,619 | 10/1962 | Fox et al. | 292/341.15 |
| 3,835,678 | 9/1974 | Meyer et al. | 292/341.16 X |
| 4,098,530 | 7/1978 | Edeus . | |
| 4,110,934 | 9/1978 | Zens . | |
| 4,159,138 | 6/1979 | Smith . | |
| 4,313,281 | 2/1982 | Richmond . | |
| 4,414,828 | 11/1983 | Takinami et al. . | |
| 4,462,185 | 7/1984 | Shibuki et al. . | |
| 4,514,001 | 4/1985 | Garcia | 292/341.16 |
| 4,530,185 | 7/1985 | Moriya et al. . | |
| 4,617,757 | 10/1986 | Kagiyama et al. . | |
| 4,618,174 | 10/1986 | Duke . | |
| 4,640,050 | 2/1987 | Yamagishi et al. . | |
| 4,667,991 | 5/1987 | Pebre | 292/DIG. 23 |
| 4,676,537 | 6/1987 | Esser . | |
| 4,707,007 | 11/1987 | Inoh . | |
| 4,738,052 | 4/1988 | Yoshida . | |
| 4,739,585 | 4/1988 | Pickles . | |
| 4,756,566 | 7/1988 | Logas | 292/341.16 |
| 4,762,348 | 8/1988 | Matsumoto | 292/201 |
| 4,775,178 | 10/1988 | Boyko . | |
| 4,842,313 | 6/1989 | Boyko et al. . | |
| 4,852,923 | 8/1989 | Harmon et al. | 292/341.18 |
| 4,862,640 | 9/1989 | Boyko et al. . | |
| 4,869,537 | 9/1989 | Compeau et al. | 292/341.18 |
| 4,881,018 | 11/1989 | Kato et al. . | |
| 4,887,390 | 12/1989 | Boyko et al. . | |
| 4,916,861 | 4/1990 | Schap . | |
| 4,982,984 | 1/1991 | Yokota et al. . | |
| 4,984,385 | 1/1991 | Deland . | |
| 5,004,280 | 4/1991 | Schap . | |
| 5,016,931 | 5/1991 | Jackson | 292/341.18 |

(List continued on next page.)

FOREIGN PATENT DOCUMENTS

| | | | |
|---|---|---|---|
| 4105684 | 9/1991 | Germany . | |
| 3-59276 | 3/1991 | Japan | 292/DIG. 23 |
| 2213866 | 8/1989 | United Kingdom . | |

*Primary Examiner*—Rodney M. Lindsey
*Attorney, Agent, or Firm*—Thomas N. Twomey; J. Gordon Lewis

[57] ABSTRACT

A power striker apparatus for a movable closure assembly includes a fixed frame defining a portal through a barrier. A movable closure is mounted on the frame for movement along a fixed path between a first end limit of movement wherein the closure is in a closed position obstructing the portal and a second end limit of movement wherein the closure is in an open position. The power striker apparatus can include a striker mounted on one of the frame and the closure. A latch mechanism is mounted on the other of the frame and the closure, so that the latch mechanism is engageable with the striker for releasibly latching the closure in the closed position. A base member is provided for supporting the striker for movement between a first position and a second position with respect to the latch mechanism. A biasing member urges the base member toward the first position. A drive mechanism moves the base member from the first position against the urging of the biasing member toward the second position. The drive mechanism can also selectively release the base member when in the second position so that the striker snaps back to the first position in response to the urging of the biasing member to dynamically drive the striker into the primary latch position of the latch mechanism from the secondary latch position.

18 Claims, 7 Drawing Sheets

U.S. PATENT DOCUMENTS 5,039,925 8/1991 Schap .
5,046,283 9/1991 Compzau et al. .
5,062,241 11/1991 Deland .
5,063,710 11/1991 Schap .
5,066,056 11/1991 Schap .
5,069,000 12/1991 Zuckerman .
5,076,016 12/1991 Adams et al. .
5,105,131 4/1992 Schap .
5,138,795 8/1992 Compeau et al. .
5,140,316 8/1992 Deland et al. .
5,142,823 9/1992 Brandenburg et al. .
5,155,937 10/1992 Yamagishi et al. .
5,172,947 12/1992 Schap .
5,189,839 3/1993 Deland et al. .
5,203,112 4/1993 Yamagishi et al. .
5,216,838 6/1993 Deland et al. .
5,222,775 6/1993 Kato .
5,232,253 8/1993 Tamiya .
5,253,451 10/1993 Hormann .
5,285,596 2/1994 Kinsey .
5,316,365 5/1994 Kuhlman et al. .
5,319,880 6/1994 Kuhlman .
5,319,881 6/1994 Kuhlman .
5,323,570 6/1994 Kuhlman et al. .
5,361,540 11/1994 Rogers, Jr. et al. .
5,389,920 2/1995 Deland et al. .
5,522,626 6/1996 Dominique ..... 292/DIG. 23

POWER STRIKER WITH OVER-RIDE CAPABILITIES

RELATED APPLICATIONS

This application is related to U.S. application Ser. No. 08/575,644 filed on Dec. 20, 1995 for "POWER STRIKER WITH INERTIALLY ACTIVATED IMPACT CYCLE".

FIELD OF THE INVENTION

The present invention relates to a power striker apparatus for engaging a striker with a latch to inertially move the striker with respect to the latch from a secondary latch position to a primary latch position, and in particular, to an apparatus and method for inertially moving the striker and latch with respect to one another from a secondary latch position to a primary latch position and for moving a sliding door of a vehicle from a location adjacent to the closed position to a fully closed position in sealed engagement with the frame around the periphery of the door opening of the vehicle.

BACKGROUND OF THE INVENTION

A typical standard automotive door latch assembly includes a striker, which can take the form of a pin, a U-shaped member or the like, fixedly mounted in the door frame to project into the door opening and into the path of movement of a latch member mounted on the edge of the door, which includes a fork bolt therein. The latch member is typically movably mounted with respect to the door and arranged so that as the door approaches its closed position, the latch member will engage the striker and further closing movement of the door will move the latch member into a safety latch position with respect to the pin, sometimes referred to as the secondary latch position, and further closing movement of the door will move the latch member into a primary latch position with respect to the pin, which positively retains the door against movement away from its closed position. It is generally known for at least part of the movement of the latch member into latched relationship with the striker to be resisted by a spring, and many users of sliding doors of this type habitually close the door with far greater force than necessary to overcome the spring bias. Greater force is generally required in the case of sliding doors, such as those employed in vans, where movement of the door through the final phase of movement to the fully closed position must compress a resilient door seal which extends around the entire periphery of the door opening.

Power striker devices have been proposed to overcome the high force requirements to move sliding doors into the fully closed position. Typically, the power striker devices are mounted on the door frame for powered movement between an outboard ready position with respect to the vehicle center line, where the latch is engaged with the striker, and an inboard holding position, where the striker holds the latch in the fully closed position. It is still required in such systems to use high force or momentum in order to ensure that the latch engages the striker in the primary latch position prior to movement into the fully closed position. When the door is open, the striker is located in its outboard ready position. After closing translation of the door is complete, the latch on the door engages the striker and latches the door to the striker while the striker is still in the outboard position. The door may engage a limit switch on the door frame when in the outboard position or may be sensed by a position sensor on the translator, which is a separate motor which drives the door between its relative positions, to actuate a drive motor which, through appropriate mechanism, drives the striker to its inboard position, such that the latched engagement between the door and striker enables the pin to drive the door to the fully closed position. With this arrangement, a closing force sufficient to engage the latch to the primary latch position with respect to the striker needs to be applied. The powered movement of the striker provides the force necessary to compress the door seal. If the striker and latch do not reach the primary latch position with respect to one another, the powered movement of the striker from its outboard position to its inboard position would not be sufficient to bring the door to the fully closed position in sealed engagement with the frame around the periphery of the door opening. In such cases, the user may be required to reopen and close the door repeatedly until the latch and striker are disposed in the primary latch position with respect to each other when in the outboard position.

SUMMARY OF THE INVENTION

The power striker according to the present invention allows any door to be closed into the secondary and primary fork bolt positions of a door latch prior to engaging the door seals. The motorized unit pulls the door into the seals assuring proper sealing of the vehicle door without the need to slam the door. The power latch either functions, or in the event of a failure may be overridden, such as if battery power should fail. The present invention virtually eliminates jamming the door and has special features to restrike the fork bolt should secondary latch position but not primary latch position be achieved. The spring return system also provides a cushioning effect for the complimentary power translation device. The power striker is particularly well adapted for use on powered sliding door devices.

The power striker apparatus includes a controlled impact cycle for engaging a striker, such as a pin, U-shaped member or the like, with respect to a latch including a fork bolt movable from a secondary latch position to a primary latch position. Typically, door seals offer high closing resistance, and require a large force or momentum to close the door. Often, a normal effort will only latch the striker in the secondary latch position, sometimes referred to as the safety latch position, even when the latching system is equipped with a power striker that allows striker engagement 12 mm to 25 mm away from the fully closed position where the door is in sealed engagement with the frame around the periphery of the door opening. The present invention provides means for snapping the spring loaded power striker into the door, when partially closed in the secondary latch position, causing the striker to move with respect to the fork bolt, such that the fork bolt moves into the primary latch position before the door can move outward from the inboard position. The power striker is then reactivated to pull the door into the fully closed inboard position in sealed engagement with the frame around the periphery of the door opening. The present invention reduces the need for the operator to reopen and re-slam the door in order to bring the striker into the primary latch position with respect to the latch prior to the operation of the power striker.

The power striker apparatus according to the present invention moves the engagement striker, such as a bolt pin, U-shaped bolt or the like, outboard to ensure that the striker reaches the primary latch position with respect to the latch mechanism prior to the power striker being reactivated to draw the door into the fully closed and sealed position. If the striker and latch mechanism are only engaged in the secondary latch position, or safety position, normally the door must be reopened and the second attempt at closing the door must be attempted by the operator. The present invention provides means for snapping or restriking the striker member outward to quickly drive the striker into the primary latch position with respect to the door latch mechanism before the door has a chance to move outward. This method of operation could produce audible sounds, and therefore, preferably would be activated only if the striker and latch mechanism did not achieve the primary latch position, or if the required door velocity to latch the striker into the primary latch position with respect to the latch mechanism is not normally achievable. The present invention may include a method of determining whether primary or secondary latch positions have been achieved, by monitoring the minimum time required to achieve the desired position. A longer time period would be associated with reaching a primary latch position, since the force to close is higher and higher torque is required of the motor and associated gear box, slowing the motor and associated gear box, thereby requiring more time to close when in the primary latch position. In the alternative, the door ajar switch can be used as an input signal to the controller logic to determine if the door is successfully closed.

A power striker apparatus according to the present invention engages a striker with a latch to move the striker with respect to the latch from a secondary latch position to a primary latch position. The power striker includes base means for supporting the striker for movement between a first position and a second position with respect to the latch. Biasing means urges the base means toward the first position. Drive means moves the base means from the first position against the urging of the biasing means toward the second position and selectively releases the base means when in the second position, so that the striker snaps back to the first position in response to the urging of the biasing means to inertially drive the striker into the primary latch position with respect to the latch when only in the secondary latch position. The power striker according to the present invention has a complimentary power translator device. The power translator device can include motor means for driving a worm and gear assembly which in turn drives a second worm and gear assembly. The gear portion of the second worm and gear assembly is fixedly connected to a crank arm which carries a roller fastened thereto. When the crank arm is driven in a first rotational direction, the roller is caused to engage a roller cam connected to the base means supporting the striker to move the striker from the first position toward the second position. When the crank arm reaches a second position, after being rotated a predetermined angle about a rotational axis with respect to the initial start position of the roller and crank arm, switch means is provided for signaling controller means for stopping the motor with the roller in the second position corresponding to the striker pin in the second position. At this point, door system logic controller means is provided for determining if the door is closed, and if the door latch fork bolt is in the primary position. If the door latch fork bolt or striker is in the primary position, the controller means will reset and be prepared to operate the crank arm in a second opposite rotational direction from the second position to the first initial position when it is desired to open the door. This typically would be a quiet operation. If the fork bolt is determined to be in the partially latched secondary position, sometimes referred to as the safety latch position, the crank arm is rotated in the first rotational direction beyond the second position, such that the roller rotates past the end of the cam surface and the base supporting the striker is spring propelled to inertially snap back to the first position against a stop. The spring load and striker inertia must be sufficient to carry the fork bolt or striker into the primary position. The crank arm can continue to rotate in the first direction until it engages the roller cam adjacent the first initial position, where it is ready for another cycle to move the door into the fully closed position with the latch and pin in the primary latch position.

Detent means can be provided movable between a first angular position disengaged from the base means and a second angular position for selectively engaging the base means when in the second angular position to hold the striker in a position immediately adjacent the second striker position. Second biasing means normally urges the detent means toward the first angular position. Rotatable cam means is driven by the crank arm and selectively engages the detent means to release the base means from the detent means. The cam means can move the detent means from the second angular or engaged position to a third angular or disengaged position, when the crank arm moves past the second striker position in the first rotational direction to inertially snap the striker back into the fork bolt to move the striker from the secondary latch position to the primary latch position with respect to the latch. The rotatable cam means is operably engageable with the crank arm when rotating to the second striker position to release and hold the base means free from the detent when it is desired to open the door.

In the event of a power failure or motor failure of the powered striker according to the present invention, the sliding door is still able to operate in a manual fashion. In particular, it is desirable in the present invention for the power striker apparatus to be capable of functioning in a manual mode if the powered function fails in either the inboard or the outboard position of the striker. The present invention provides this desirable characteristic by including a detent engageable with a base supporting the striker in order to hold the striker in a position immediately adjacent the second striker position, sometimes referred to as the inward position with the door in the fully sealed and closed position. Manual release of the latch by actuation of the sliding door handle does not effect the position of the detent with respect to the base supporting the striker. Even if the powered striker apparatus fails with the striker in the outboard position, the sliding door can be moved to the fully closed and sealed position manually driving the base sufficiently toward the inboard striker position causing the detent to engage and hold the base in the inboard position until the failure of the powered drive is remedied.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 12:
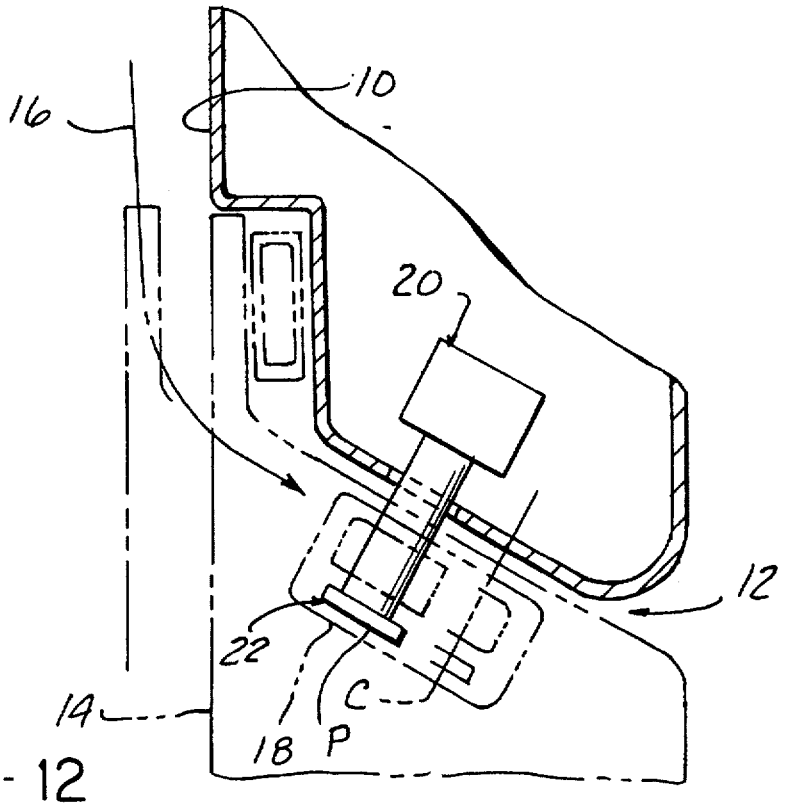
FIG. 12 is a simplified cross-sectional schematic view of a movable closure assembly including a fixed frame defining a portal through a barrier with a latch and striker mechanism according to the present invention.

The construction of a movable closure assembly including a fixed frame defining a portal 12 through a barrier 10, where the movable closure 14 is mounted on the frame for movement along a fixed path 16 between a first end limit of movement obstructing the portal 12 and a second end limit of movement allowing ingress and egress through the portal 12 are well known and commercially available from a variety of sources. The present invention is directed to certain components of a power drive system by means of which a movable closure 14, such as a sliding door, hatch, roof panel, window or the like can be power driven into a primary latch position P and a fully closed position C in sealed engagement with the frame around the periphery of the portal 12, such a door opening for a sliding door of a vehicle, as shown schematically in FIG. 12. Various details of such sliding door structures and power drive systems can be obtained from U.S. patent application Ser. No. 08/501,557 filed Jul. 12, 1995 for "AN ACCELERATION CLUTCH WITH OVER-RIDE CAPABILITY" and U.S. patent application Ser. No. 08/575,644 filed on Dec. 20, 1995 for "POWER STRIKER WITH INERTIALLY ACTIVATED IMPACT CYCLE" which are incorporated by reference herein in their entirety.

Typically, a barrier, such as a wall 10 of a vehicle, for example a van-type vehicle, has a movable closure, such as a sliding door 14 located on at least one side of the vehicle. Vans using such sliding doors 14 have been available for years and the structural arrangements by which the doors 14 are mounted on the vehicle for movement between the closed position C where the door 14 is sealingly seated in a door opening, and an open position, where the door 14 is disposed at the side of the van rearwardly of the door opening are well known. In the standard arrangement, the door 14 is latched in its closed position C, typically by mechanical latches 18 at the front and rear edges of the door, and the latches 18 are mechanically linked to a latch actuator mounted within the door 14 to be simultaneously released by actuation of manually operated door handles, or electronically as part of a power door drive system. In many cases, the rear latch 18 may include a power driven striker mechanism which is latchingly engaged with the door 14 as it approaches its closed position and is power driven to move the latched door to its fully closed position C. The employment of an electronic control unit enables the power drive for the door 14 to be operated in a safe and efficient manner, as by providing the door 14 with an anti-pinch capability by automatically stopping the drive if an object becomes trapped between the closing door and the door frame, providing for express operation and eliminating the need for limit switches to sense specific door positions. Electronic control units capable of being programmed to perform these, and similar functions, are well known and commercially available from a variety of sources.

A barrier 10 is a construction forming an extended indefinite surface preventing or inhibiting the passage of persons or things, and can include a wall, ceiling, roof or cover for a stationary structure or a movable vehicle, such as a vertically extending wall of a van-type vehicle. A portal 12 is structure defining an opening through the barrier for passage of persons or things, such as the framing of a door, window, hatch or roof panel opening. A movable closure 14 is an obstructive structure whose presence in or before a passage bars traffic through the passage and is mounted to move in a regular, repetitive, predetermined path with respect to the portal so as to alternately open or close the passage, and can take the form of a hatch, a sliding window, a roof panel or a sliding door.

Figure 1:
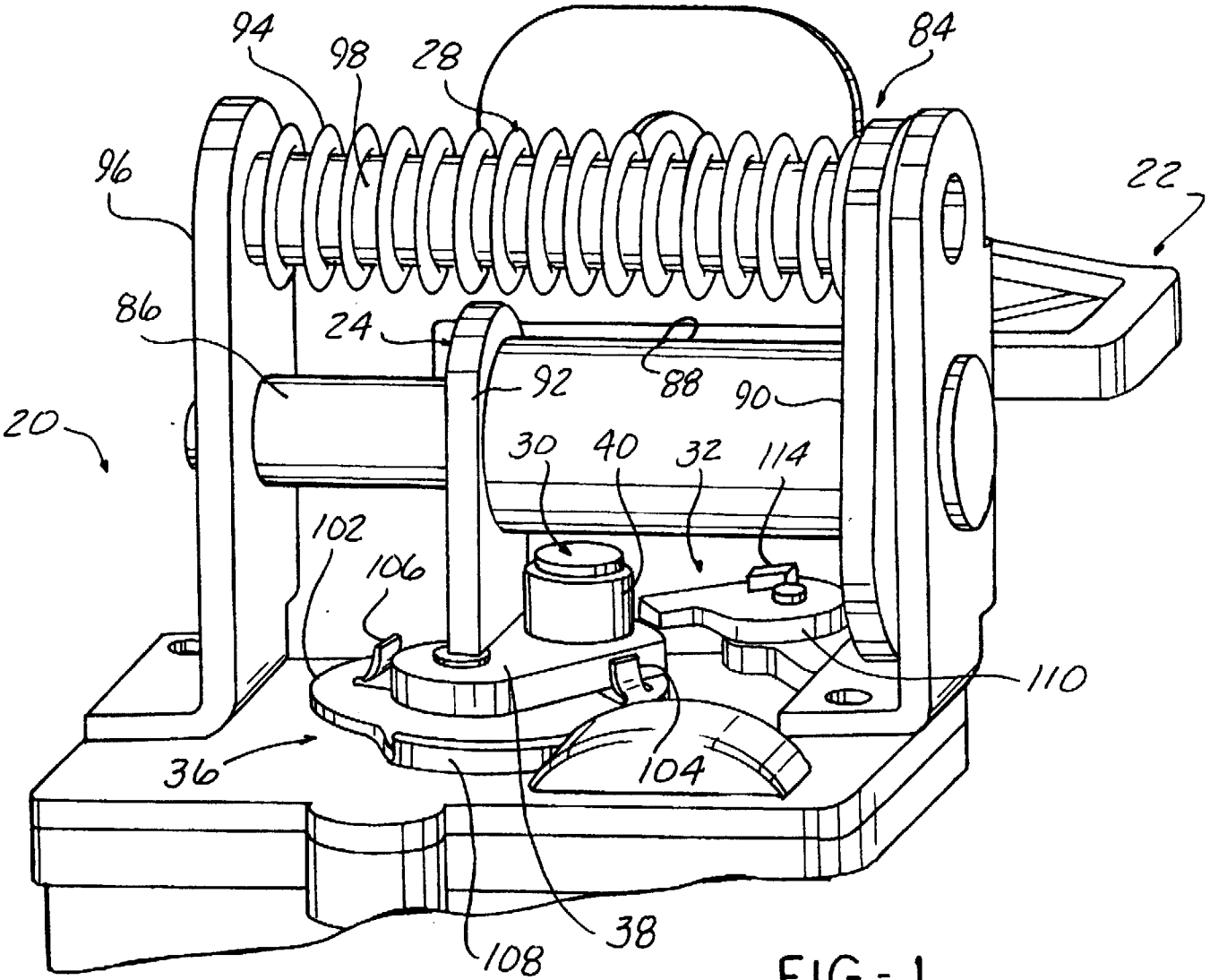
FIG. 1 is a rear perspective view of a power striker apparatus according to the present invention with the striker in a first position.
Figure 2:
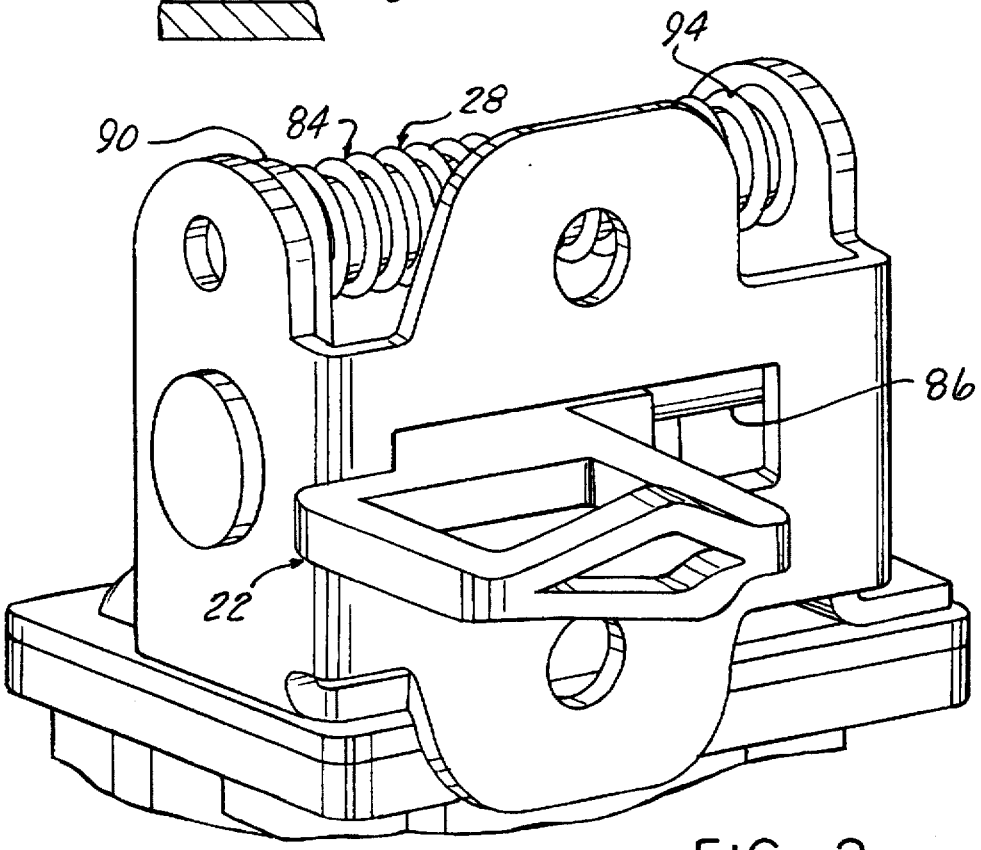
FIG. 2 is a front perspective view of the power striker apparatus according to the present invention with the striker in the first position.

Referring now to FIGS. 1 and 2, perspective rear and front views of a power striker apparatus 20 according to the present invention are illustrated. The power striker apparatus 20 can include a striker 22 such as a striker pin, fork bolt, U-shaped striker or the like, in a first outboard position with respect to a longitudinally extending center line of the vehicle as illustrated in FIGS. 1 and 2. Base means 24 is provided for supporting the striker 22 for movement between the first position (illustrated in FIG. 5) and a second position (illustrated in FIG. 7) with respect to a latch mechanism (not shown). Biasing means 28 urges the base means 24 toward the first position. Drive means 30 operably moves the base means 24 from the first position against the urging of the biasing means 28 toward the second position. The drive means 30 can selectively release the base means 24 when in the second position as a result of further rotational movement, such that the striker 22 snaps back to the first position in response to the urging of the biasing means 28 to inertially drive the striker 22 into the primary latch position when the striker 22 is only in the secondary latch position with respect to the latch mechanism. Control means can operably actuate the drive means 30 for moving the base means 24 between the first and second positions. Sensor means can signal when the base means 24 is in the second position. Stop means can be provided to limit movement of the base means 24 to define the first position and to absorb impact from the base means 24 during return movement to the first position from the second position.

The power striker apparatus 20 can also include detent means 32 movable between a first angular position or disengaged position (illustrated in FIG. 5) and a second angular position or engaged position (illustrated in FIG. 6) for selectively engaging the base means 24 when in the engaged position to hold the striker 22 in the second position. Second biasing means 34 is provided for urging the detent means 32 normally toward the first angular position or disengaged position illustrated in FIG. 5. Cam means 36 can be provided for selectively engaging the detent means 32 to release the base means 24 from the detent means 32.

Figure 4:
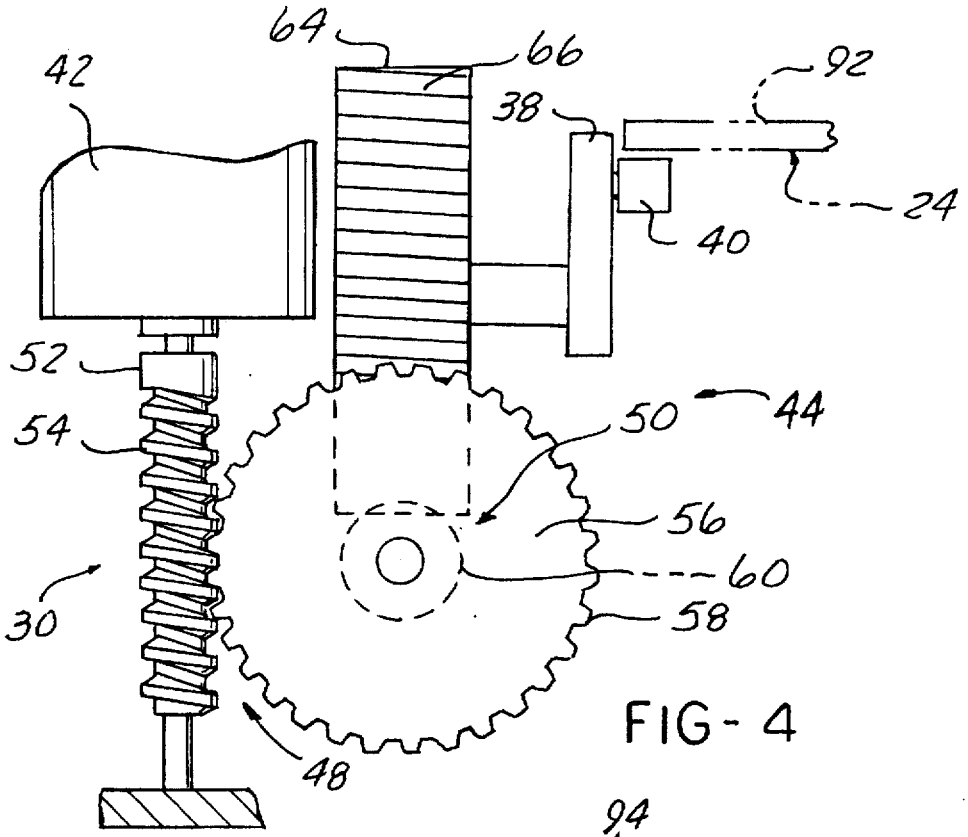
FIG. 4 is a schematic cross-sectional view taken as shown in FIG. 3 illustrating drive means according to the present invention for moving base means supporting a striker.
Figure 3:
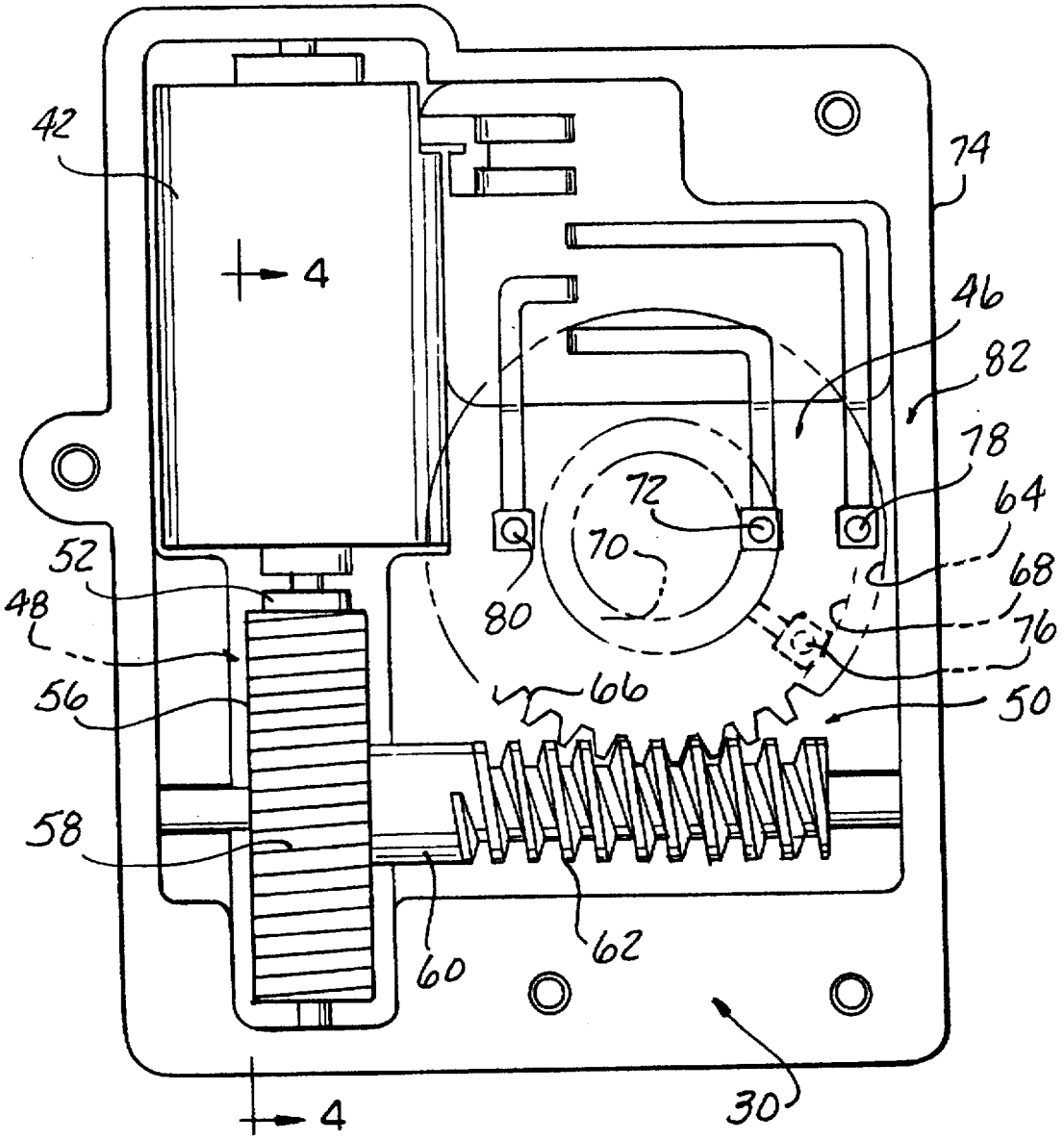
FIG. 3 is a plan view of motor means according to the present invention for driving the power striker with various components removed or shown in phantom for clarity purposes.

Referring now to FIGS. 3 and 4, the drive means 30 can include a crank arm 38 rotatable about a first axis and a roller 40 connected to the crank arm 38 adjacent an outer end for driving the base means 24. The drive means 30 can also include a motor 42, such as a reversible electric motor, for providing a rotatable output shaft in response to a switchable connection to a power supply. Gear means 44 is provided for transmitting rotary motion from the rotatable output shaft of the motor 42 to the crank arm 38. Switch means 46 can be provided for signaling when the crank arm 38 is in a position corresponding to the first position and/or the second position of the base means 24.

In the illustrated embodiment of the gear means 44 shown in FIGS. 3 and 4, the drive means 30 can include the motor 42 for driving a first worm and gear assembly 48 which in turn drives a second worm and gear assembly 50. The first worm and gear assembly 48 can include a first worm 52 connected to the rotatable output shaft of the motor 42 for rotation with the output shaft. The first worm 52 has at least one helically extending tooth operably engageable with a first gear 56 of the first worm and gear assembly 48. The first gear 56 includes a plurality of first gear teeth extending around an external periphery of the first gear 56. In the illustrated embodiment, the rotational axis of the first worm 52 is substantially perpendicular to and offset from the rotational axis of the first gear 56. Of course, it should be recognized that the rotational axes could be skewed or crossed with respect to one another. The second worm and gear assembly 50 includes a second worm 60 connected to the first gear 56 for rotation with the first gear about a common rotational axis. The second worm 60 includes at least one helically extending tooth 62 operably engageable with a second gear 64. The second gear 64 includes a plurality of second gear teeth 66 extending around an external periphery of the second gear 64. In the illustrated embodiment, the rotational axis of the second worm is substantially perpendicular to and offset from the rotational axis of the second gear 64. Of course, it should be recognized that these rotational axes could also be skewed or crossed with respect to one another. As illustrated, the rotational axis of the first worm is substantially perpendicular to and offset from the rotational axis of the second gear. The crank arm 38 is connected to the second gear 64 for rotation with the second gear 64 about a common rotational axis. The rotational axis of the roller 40 is generally parallel to and offset from the rotational axis of the second gear 64.

The pressure angle on the gear teeth are skewed 9° to 11° to improve efficiency. The other side of the gear tooth is formed with approximately a 20° pressure angle to increase the base width. Forming the tooth with a pressure angle of 9° to 11° on one side and a 20° pressure angle on the opposite side improves the efficiency on the driving side, and improves bearing efficiency on the driving side by reducing separating forces, while it maintains substantially the same bending load resistance as a tooth form having complimentary mirror image pressure angles.

The power striker apparatus 20 according to the present invention allows the movable closure to continue operating normally even if the motor 42 stops operating, since the striker apparatus will continue to work in response to manual manipulation of the closure member, as will be described in greater detail below. It is desirable in the present invention to isolate the motor 42 from the frame of the vehicle in order to reduce the amount of noise generated by operation of the power striker apparatus 20. It should be recognized that conventional noise abatement techniques can be employed to achieve the amount of noise reduction desired.

The second gear 64 can support a contact switch plate 68 connected for rotation with the second gear 64. The contact switch plate 68 shown in phantom in FIG. 3 can have an annular contact ring 70 electrically connected to a first contact 72 connected to a housing portion 74 enclosing the drive means 30. The annular contact ring 70 formed on the contact switch plate 68 can be electrically connected to a radially outer electrical contact 76 for angular movement between a second contact 78 and a third contact 80 connected to or supported by the housing portion 74 enclosing the drive means 30. The electrical connection can be closed when the radially outer electrical contact 76 makes contact with the second contact 78 in a first angular position, which may correspond to the striker in the first position. The radially outer electrical contact 76 can lose electrical connection with the second contact 78 as the second gear 64 is rotated about the rotational axis. When the radially outer electrical contact 76 makes electrical connection with the third contact 80, this can signal that the second gear 64 is in a second angular position, which may correspond to the striker being in the second position. The contact switch plate 68 and contacts 70, 72, 76, 78 and 80 can define sensor means 82 for signaling when the base means 24 is in the first and/or second position. In the alternative, the entire contact switch plate 68 can be electrically conductive with cut out portions to open the circuit when the second gear 64 reaches the first or second position. It should be recognized that the power striker apparatus 20 according to the present invention can be used with a different sensor configuration. In addition, it should be recognized that the power striker apparatus 20 can be run without a controller. Furthermore, the crank arm 38 according to the present invention has variable mechanical advantage allowing force monitoring for obstacle detection, if desired. The sensor means 82 can provide an appropriate signal to control the motor 42. For example, by way of illustration and not limitation, the motor 42 may be energized to drive the crank arm 38 until the radially outer electrical contact 76 carried by the second gear 64 engages either the second contact 78 or the third contact 80 at which time the motor 42 may be switched off with the striker 22 held in either the outboard or the inboard position.

The base means 24 can include guide means 84 for guiding the base means 24 along a fixed path as it moves between the first and second position of the striker 22. The guide means 84 can include an elongated member 86, such as a rod or bar having a particular cross-sectional configuration and a complimentary sheathing or engaging portion 88 operably engageable with the elongated member 86 for guided movement between the first and second positions. In the illustrated embodiment, the elongated member 86 can be a cylindrical rod and the engaging portion 88 can be in the form of an elongated cylindrical portion having first and second ends. First and second plates 90 and 92 can be attached to the engaging portion 88 adjacent the first and second ends respectively as best seen in FIG. 1.

The biasing means 28 can include a compression spring 94 operably engageable with the base means 24 to urge the base means 24 toward the first position. In the illustrated embodiment of FIG. 1, the biasing means 28 can be interposed between a first support member 96 and the first plate 90 of the base means 24. To prevent rotation of the elongated cylindrical engaging portion 88 with respect to the elongated rod member 86, the first plate 90 can include an aperture engageable with a second elongated member 98. In the illustrated embodiment, a compression spring 94 can sheath a portion of the second elongated member 98 having a first spring seat at one end on the first plate 90 and a second spring seat at an opposite end on the first support member 96. It should be recognized that the second elongated member 98 may be eliminated when the elongated member 86 of the guide means 84 is a non-cylindrical shape, such that the engaging portion 88 is held in a non-rotatable or consistent orientation as the base means 24 moves between the first and second positions. In the case of a non-circular cross-section elongated member 86, the biasing means 28 can be disposed operably engaged between the first support member 96 and the base means 24. For example, by way of illustration and not limitation, the biasing means 28 may include a compression spring 94 sheathing a portion of the elongated member 86 (not shown).

Figure 5:
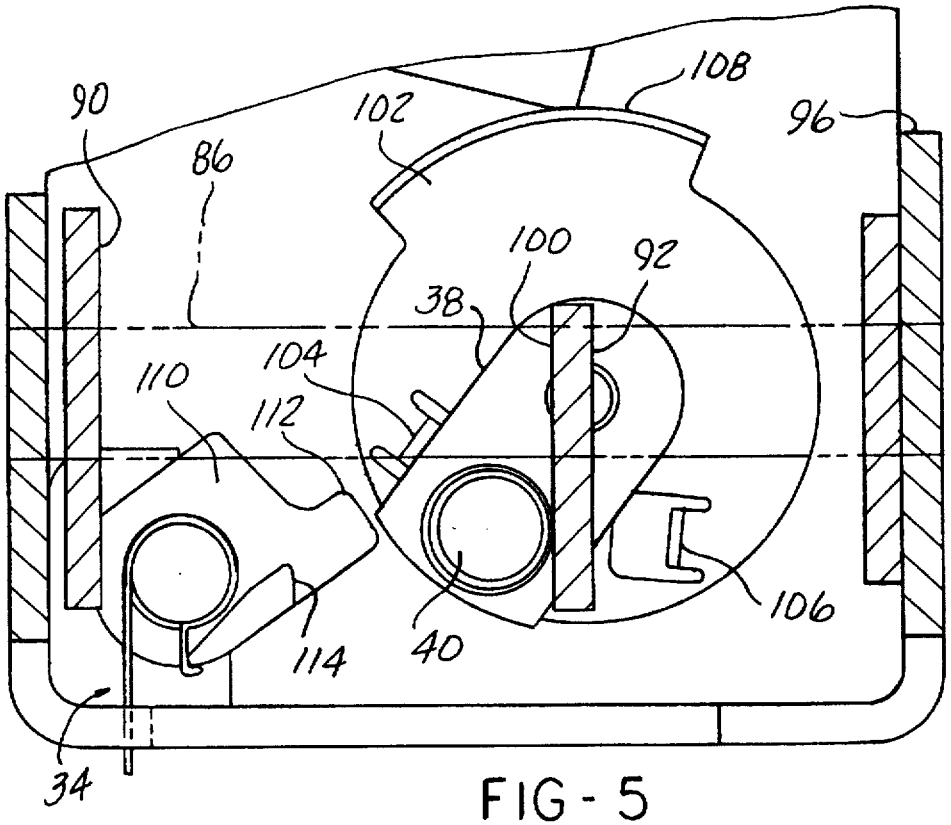
FIG. 5 is a cross-sectional plan view of the striker apparatus according to the present invention with the base means supporting the striker in a first position.

Referring now to FIGS. 5–11, the operation of the power striker apparatus 20 according to the present invention will be described in greater detail. FIG. 5 illustrates the power striker apparatus 20 with the striker 22 in a first or outboard position. As illustrated, the first plate 90 of the base means 24 is in a left-most position with respect to the guide means 84 (shown in phantom since it is above the cross-sectional line for purposes of clarity). The second plate 92 of the base means 24 is spaced from the first support member 96 as a result of the biasing means 28 acting on the base means 24 to drive the striker 22 toward the first position. The second plate 92 includes a cam surface 100 engageable with the roller 40 carried by the crank arm 38. This orientation of the power striker apparatus 20 according to the present invention can correspond to the movable closure in an open position after the striker 22 had been released from the second position by reversing motor 42 to drive the crank arm 38 in a clockwise direction to the position shown in FIG. 5, which will be referred to as the initial unlatched or outboard position. The cam means 36 can include a rotatable member 102 mounted for independent rotation about a common axis with the second gear 64 and crank arm 38. The rotatable member 102 is driven in rotation about the common axis by engagement of the crank arm 38 with one of first and second outwardly extending tabs, 104 and 106 respectively. When the crank arm 38 is rotated in the clockwise direction, the crank arm 38 can engage outwardly extending tab 104 to rotate the rotatable member 102 in the clockwise direction. When the crank arm 38 is rotated in the counterclockwise direction, the crank arm 38 can engage the outwardly extending tab 106 to drive the rotatable member 102 in counterclockwise rotation as viewed in the illustration. Lost motion occurs between the rotatable member 102 and the crank arm 38 for a predetermined amount of angular movement of the crank arm 38 corresponding to the angular distance set between contact with the first outwardly extending tab 104 when rotating in a first direction, and contact with the second outwardly extending tab 106 when rotated in an opposite second direction. The lost motion is desirable in the present invention to provide disengagement of the detent means 32 from the first plate 90 of the base means 24 as will be described in greater detail with respect to FIGS. 7 and 8. The rotatable member 102 includes at least one lobe or cam surface 108 selectively engageable with the detent means 32 for moving the detent means 32 from the second angular position or engaged position (shown in FIG. 6) to a third angular position or disengaged position (shown in FIGS. 7 and 8).

The detent means 32 is normally biased in a counterclockwise direction toward the first angular position shown in FIG. 5 by second biasing means 34. The detent means 32 can include a rotatable detent member 110 having at least one cam surface 112 formed on the detent member 110 for operable engagement with the cam surface 108 formed on the rotatable member 102. The detent member 110 can also include an outwardly extending detent or protrusion 114 operably engageable with the first plate 90 of the base means 24 as can be seen in FIG. 6.

Figure 6:
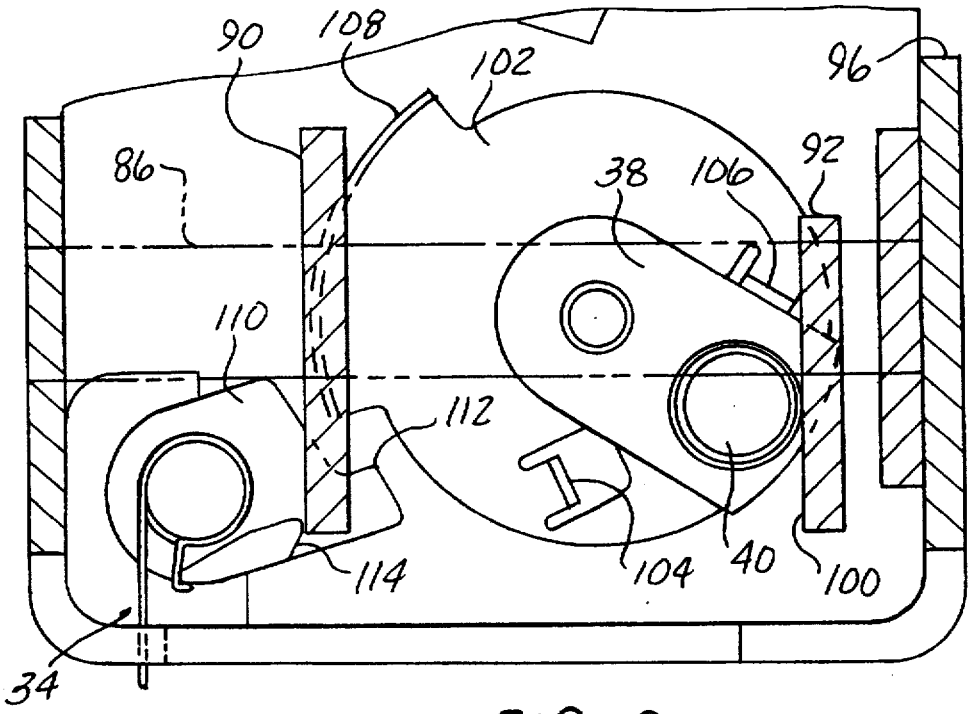
FIG. 6 is a cross-sectional plan view of the power striker apparatus according to the present invention with the base means supporting the striker in a position immediately adjacent the second position.

When the motor 42 is operated to drive the crank arm 38 in the counterclockwise direction from the outboard rest position shown in FIG. 5 to the position shown in FIG. 6, the roller 40 engages the cam surface 100 formed on the second plate 92 of the base means 24 to drive the supported striker 22 from the first position toward the second position. As the crank arm 38 rotates in a counterclockwise direction, the crank arm 38 engages the tab 106 of the rotatable member 102 to drive the rotatable member in a counterclockwise direction. As the base means 24 moves from the first position toward the second position, the first plate 90 slidably engages the outwardly extending detent 114 formed on the rotatable detent member 110 causing rotation of the rotatable detent member in the clockwise direction against the urging of the counterclockwise bias of the rotatable detent member 110. The crank arm 38 and roller 40 drives the base means 24 against the urging of the biasing means 28.

When the crank arm 38 has rotated to the position shown in FIG. 6, the first plate 90 of the base means 24 passes over the detent 114 allowing the rotatable detent member 110 to rotate counterclockwise to maintain the base means 24 in a position adjacent the second end limit of movement or inboard position. This function of the detent means 32 allows the power striker apparatus 20 of the present invention to operate even in the event of a failure of the motor 42 or gear means 44.

Figure 11:
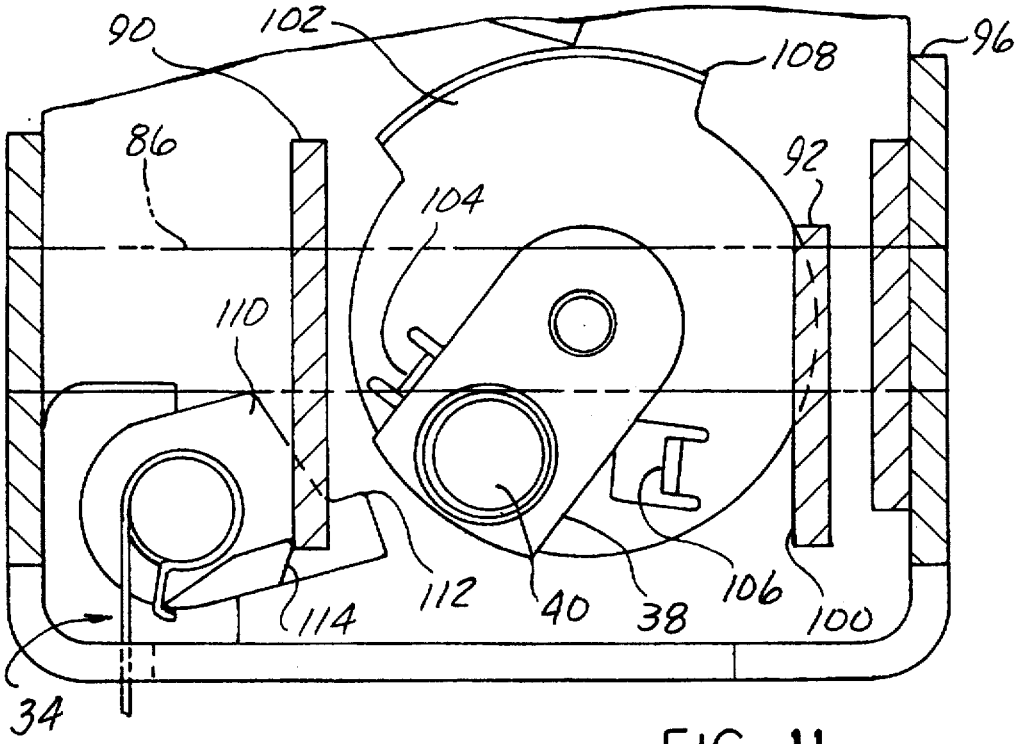
FIG. 11 is a cross-sectional plan view of the power striker according to the present invention with the detent means holding the base means in the inboard position after a failure of the power drive to the crank arm when in the outboard position.

In response to manual manipulation of the movable closure after a power failure or drive failure with the striker 22 in the outboard position, the base means 24 would be driven from the first outboard position toward the second inboard position causing the first plate 90 of the base means 24 to be captured in the second inboard position by the detent 114 of the rotatable detent member 110 as illustrated in FIG. 11. The latch mechanism can still be manually released with the door handle to move the movable closure between the open and closed positions repeatedly as desired and the detent 114 will continue to hold the striker in the inboard position until the power drive failure is remedied. Therefore, the detent 114 of the present invention allows the movable closure, such as a van sliding door to seal without powered operation. The sliding door may be manually sealed repeatedly as desired. In addition, the biasing means 28 operates as a spring hold out feature to provide a cushion at the door closed position.

Figure 7:
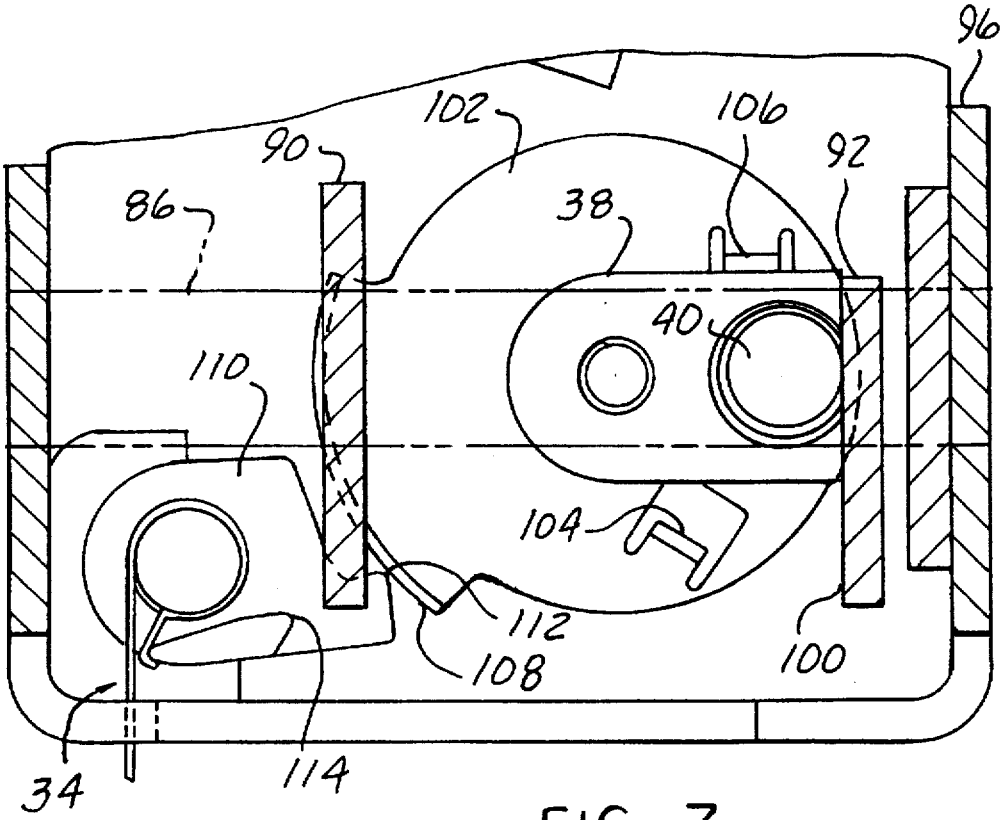
FIG. 7 is a cross-sectional plan view of the power striker apparatus according to the present invention with the crank arm further rotated into the second position with the base means in a third position corresponding to an end limit of movement furthest from the first position and released from detent means prior to restriking or reversing movement to reset the striker in response to the door opening.

As the crank arm 38 continues to rotate in the counterclockwise direction from the position shown in FIG. 6 to the position shown in FIG. 7, the lobe or cam surface 108 of the rotatable member 102 is driven into contact with the cam surface 112 of the rotatable detent member 110 to again urge the rotatable detent member 110 in the clockwise direction against the normal urging of the biasing means acting on the rotatable detent member 110. When the crank arm 38 reaches the position illustrated in FIG. 7, the striker 22 has reached the second or inboard position, and the detent 114 is held in a position allowing movement of the first plate 90 past the detent 114 to the first position either by further rotational movement of the crank arm in the counterclockwise direction, or by reversing movement of the crank arm in the clockwise direction. The rotatable member 102 is driven between the position shown in FIG. 6 and the position shown in FIG. 7 by continued engagement of the crank arm 38 with the second outwardly extending tab 106. The lobe or cam surface 108 engages the cam surface 112 on the detent member 110 to hold the detent 114 out of engagement when the crank arm 38 is powered for rotation in either direction. This allows the return of the base means 24 and supported striker 22 to the outboard position without the overriding action of the detent 114.

Figure 8:
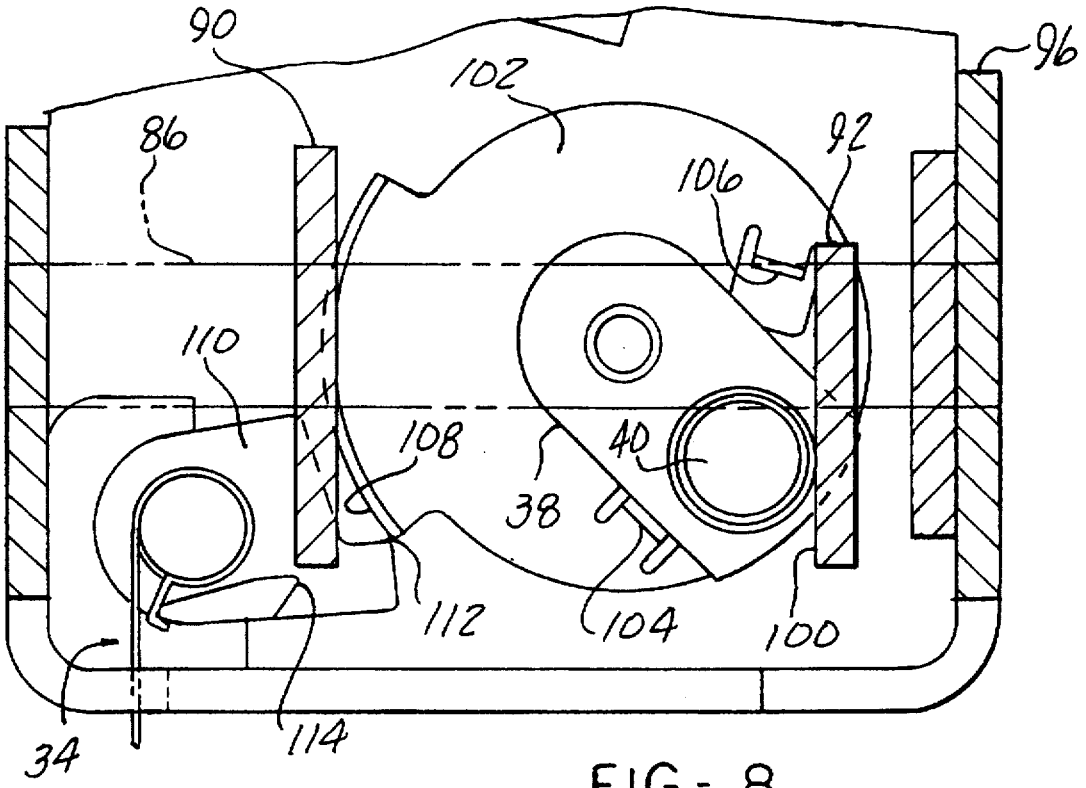
FIG. 8 is a cross-sectional plan view of the power striker apparatus according to the present invention with a crank arm rotating in a first rotational direction for restriking the striker.

When the rotation of motor 42 is reversed to drive the crank arm 38 in the clockwise direction from the position shown in FIG. 7 to that illustrated in FIG. 8, the first plate 90 of the base means 24 is allowed to pass the detent 114 of the detent member 110 due to the lobe or cam surface 108 of the rotatable member 102 still engaging the cam surface 112 of the detent member 110 as a result of the lost motion before the crank arm 38 engages the first outwardly extending tab 104 formed on the rotatable member 102. This allows free movement of the base means 24 and supported striker 22 during a powered operation resetting the striker from the inboard position to the outboard position. Further clockwise rotation of the crank arm 38 from the position shown in FIG. 8 would return the power striker apparatus 20 to the position illustrated in FIG. 5. This would complete the normal powered operation between the first and second positions of the striker 22.

Figure 9:
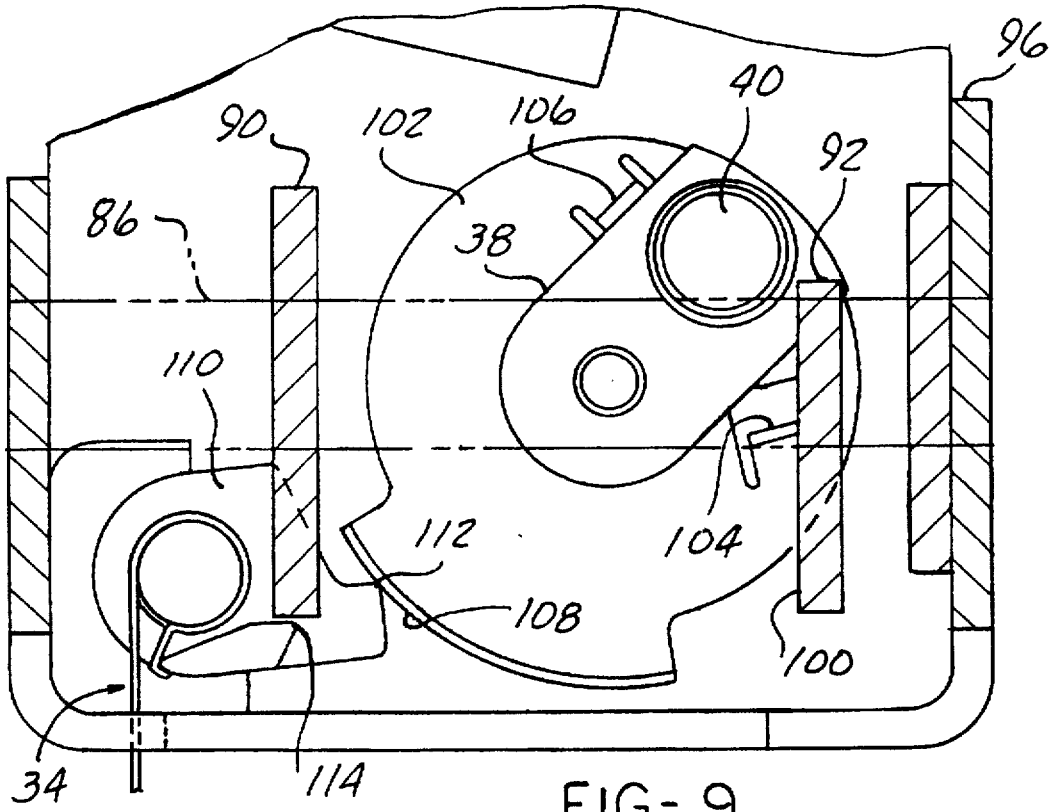
FIG. 9 is a cross-sectional plan view of the power striker apparatus according to the present invention with the crank arm further rotated in the first rotational direction with the roller approaching the end of a cam surface formed on the base means prior to restriking.
Figure 10:
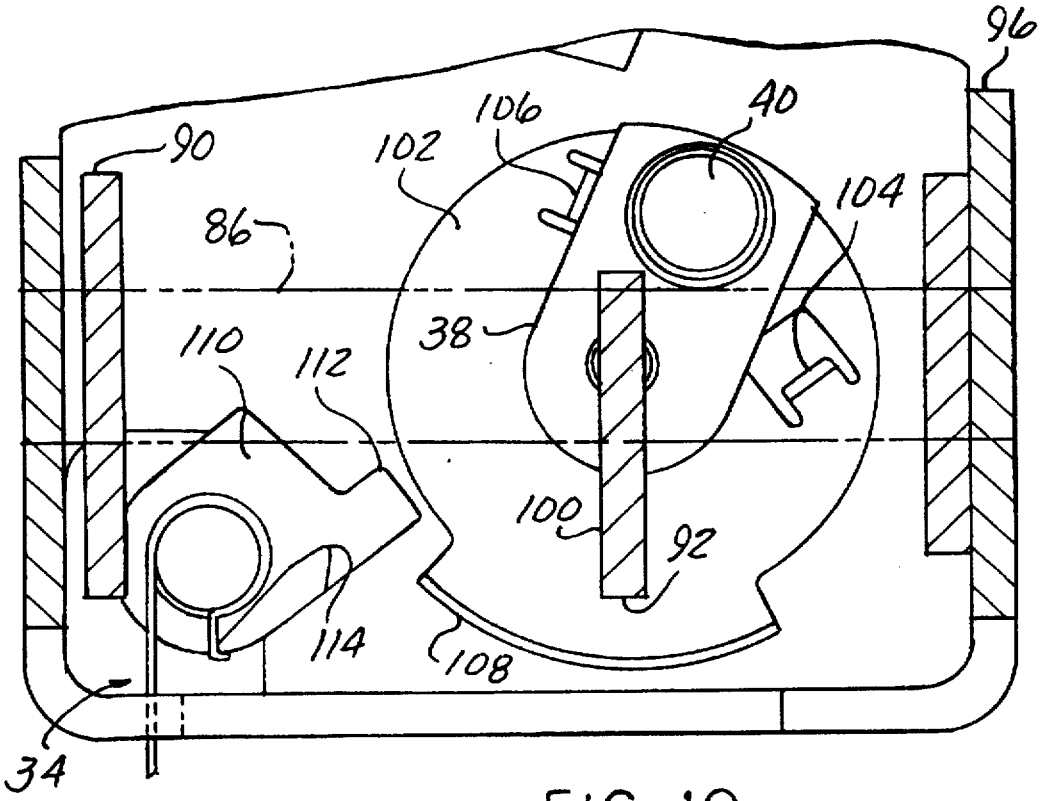
FIG. 10 is a cross-sectional plan view of the power striker apparatus according to the present invention with the base means driven back to the first position by biasing means after the roller disengages from the cam surface formed on the base means for restriking the striker with respect to the latch.

The powered striker apparatus 20 of the present invention also provides a restriking capability as illustrated in FIGS. 9 and 10. With the crank arm 38 in the position illustrated in FIG. 7, if the controller determines that the latch is only in the secondary latch position with respect to the striker 22, the crank arm 38 can be powered to continue counterclockwise rotation to the position shown in FIG. 9. The lobe or cam surface 108 of the rotatable member 102 continues to engage the cam surface 112 of the detent member 110 to hold the detent 114 in a position allowing passage of the first plate 90 of the base means 24. As the roller 40 reaches the end of the cam surface 100 formed on the second plate 92 of the base means 24, the crank arm 38 continues to engage the outwardly extending tab 106 of the rotatable member 102 to also drive the rotatable member 102 in the counterclockwise direction. Further counterclockwise rotation of the crank arm 38 from the position shown in FIG. 9 to the position shown in FIG. 10, will release the second plate 92 of the base means 24 from the roller 40 allowing the biasing means 28 to drive the base means 24 from a position adjacent the second or inboard position toward the first or outboard position in a restriking or snap action to the position shown in FIG. 10. Snapping the spring loaded power striker 22 into the latch of the door, when partially closed in the secondary latch position, causes the striker 22 to move with respect to the fork bolt, such that the fork bolt moves into the primary latch position before the door can move outward from the inboard position. The power striker apparatus 20 can then be reactivated by continuing counterclockwise rotation of the crank arm 38 until it reaches the position illustrated in FIG. 5. When in the position generally illustrated in FIG. 5, the power striker apparatus 20 can then be reactivated to pull the door into the fully closed inboard position in sealed engagement with the frame around the periphery of the door opening corresponding to that illustrated in FIG. 7 as previously described above.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A power striker apparatus for engaging a latch to move said latch from a secondary latch position to a primary latch position comprising:

a striker for engaging said latch in said secondary latch position where said latch is partially engaged with respect to said striker and said primary latch position where said latch is fully engaged with respect to said striker;

base means moveable between a first position and a second position for supporting said striker for movement with respect to said latch;

biasing means for urging said base means toward said first position; and drive means for moving said base means from said first position against said urging of said biasing means toward said second position and for selectively releasing said base means if said latch is in said secondary latch position with respect to said striker when said base means is in said second position, such that said base means snaps back to said first position in response to said urging of said biasing means to drive said striker toward said latch to move said latch into said primary latch position with respect to said striker from said secondary latch position; and guide means for guiding said base means in movement along a fixed straight path in a predetermined orientation with respect to said drive means between said first and second positions.

2. The power striker apparatus of claim 1 further comprising:

said base means including an elongated cylindrical portion having first and second ends, and first and second outwardly extending plates attached to said cylindrical portion adjacent said first and second ends respectively.

3. The power striker apparatus of claim 1 further comprising:

said biasing means including a compression spring operably engageable with said base means to urge said base means toward said first position.

4. A power striker apparatus for engaging a latch to move said latch from a secondary latch position to a primary latch position comprising:

a striker for engaging said latch;

base means moveable between a first position and a second position for supporting said striker for movement with respect to said latch;

biasing means for urging said base means toward said first position;

drive means for moving said base means from said first position against said urging of said biasing means toward said second position and for selectively releasing said base means when in said second position, such that said base means snaps back to said first position in response to said urging of said biasing means to drive said striker into said primary latch position with respect to said latch from said secondary latch position; and detent means, moveable between a disengaged position and an engaged position, for selectively engaging said base means when in said engaged position to hold said base means in said second position.

5. The power striker apparatus of claim 4 further comprising:

second biasing means for urging said detent means normally toward said engaged position.

6. The power striker apparatus of claim 4 further comprising:

cam means for selectively engaging said detent means to release said base means from said detent means.

7. The power striker apparatus of claim 6 further comprising:

said cam means including at least one cam surface selectively engageable with said detent means for moving said detent means from said engaged position toward said disengaged position.

8. A power striker apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said power striker apparatus comprising:

a striker for being mounted on one of said frame and said closure;

latch means for being mounted on the other of said frame and said closure, said latch means engageable with said striker in a secondary latch position and a primary latch position for releasably latching said closure in said closed position, said latch means operable during movement of said closure toward said closed position to interlock with said striker to releasably latch said closure against movement relative to said striker;

base means moveable between a first position and a second position for supporting said striker for movement with respect to said latch means;

biasing means for urging said base means toward said first position; and drive means for moving said base means from said first position against said urging of said biasing means toward said second position and for selectively releasing said base means when in said second position, so that said striker snaps back to said first position in response to said urging of said biasing means to drive said striker into said latch means to move said latch means into said primary latch position from said secondary latch position, said drive means including a crank arm rotatable about a first axis and a roller connected to said crank arm for driving said base means.

9. A power striker apparatus for engaging a latch to move said latch from a secondary latch position to a primary latch position comprising:

a striker for engaging said latch;

base means moveable between a first position and a second position for supporting said striker for movement with respect to said latch;

biasing means for urging said base means toward said first position; and drive means for moving said base means from said first position against said urging of said biasing means toward said second position and for selectively releasing said base means when in said second position, such that said base means snaps back to said first position in response to said urging of said biasing means to drive said striker into said primary latch position with respect to said latch from said secondary latch position, said drive means including a crank arm rotatable about a first axis and a roller connected to said crank arm for driving said base means.

10. The power striker apparatus of claim 9 further comprising:

said drive means including a reversible electric motor, gear means for transmitting rotary motion from said motor to said crank arm, and switch means for signalling when said base means is in at least one of said first and second positions.

11. A power striker apparatus for a vehicle including a door frame defining a door opening, a door slidably mounted on said frame for movement between an open position wherein said door is withdrawn to one side of said opening and a fully closed position wherein said door is received in sealed engagement with said frame around the periphery of said door opening, and a releasable latch and striker combination on said door and frame for latching said door with respect to said frame in response to closing movement of said door to a location adjacent to said fully closed position, said power striker apparatus for moving said door into said fully closed position from said location adjacent to said fully closed position, said power striker apparatus comprising:

means for selectively moving said latch and striker combination from a secondary latch position where said latch is partially engaged with respect to said striker to a primary latch position where said latch is fully engaged with respect to said striker if said latch and striker combination is in said secondary latch position and for moving said door from said location adjacent said fully closed position to said fully closed position in sealed engagement with said frame around the periphery of said door opening if said latch and striker combination is in said primary latch position; and detent means, moveable between a disengaged position and an engaged position, for selectively engaging said striker when in said engaged position to hold said door in said fully closed position during manual release of said latch and manual manipulation of said door between said open position and said fully closed position.

12. A power striker apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said power striker apparatus comprising:

a striker for being mounted on one of said frame and said closure;

latch means for being mounted on the other of said frame and said closure, said latch means engageable with said striker in a secondary latch position and a primary latch position for releasably latching said closure in said closed position, said latch means operable during movement of said closure toward said closed position to interlock with said striker to releasably latch said closure against movement relative to said striker;

base means moveable between a first position and a second position for supporting said striker for movement with respect to said latch means;

biasing means for urging said base means toward said first position;

drive means for moving said base means from said first position against said urging of said biasing means toward said second position and for selectively releasing said base means when in said second position, so that said striker snaps back to said first position in response to said urging of said biasing means to drive said striker into said latch means to move said latch means into said primary latch position from said secondary latch position; and detent means, moveable between a disengaged position and an engaged position, for selectively engaging said base means when in said engaged position to hold said base means in said second position.

13. The power striker apparatus of claim 12 further comprising:

second biasing means for urging said detent means normally toward said disengaged position.

14. The power striker apparatus of claim 12 further comprising:

cam means for selectively engaging said detent means to release said base means from said detent means.

15. The power striker apparatus of claim 14 further comprising:

said cam means including at least one lobe selectively engageable with said detent means for moving said detent means from said engaged position toward said disengaged position.

16. A power striker apparatus for a moveable closure assembly including a fixed frame defining a portal through a barrier, a moveable closure mounted on said frame for movement along a fixed path between a first end limit of movement wherein said closure is in a closed position obstructing said portal and a second end limit of movement wherein said closure is in an open position, said power striker apparatus comprising:

a striker for being mounted on one of said frame and said closure;

latch means for being mounted on the other of said frame and said closure, said latch means engageable with said striker in a secondary latch position where said latch means is partially engaged with respect to said striker and a primary latch position where said latch means is fully engaged with respect to said striker and for releasably latching said closure in said closed position, said latch means operable during movement of said closure toward said closed position to interlock with said striker to releasably latch said closure against movement relative to said striker;

base means moveable between a first position and a second position for supporting said striker for movement with respect to said latch means;

biasing means for urging said base means toward said first position; and drive means for moving said base means from said first position against said urging of said biasing means toward said second position and for selectively releasing said base means if said latch means is in said secondary latch position with respect to said striker when said base means is in said second position, so that said base means snaps back to said first position in response to said urging of said biasing means to drive said striker into said latch means to move said latch means into said primary latch position from said secondary latch position; and guide means for guiding said base means in movement along a fixed straight path in a predetermined orientation with respect to said drive means between said first and second positions.

17. The power striker apparatus of claim 16 further comprising:

said base means including an elongated cylindrical portion having first and second ends, and first and second outwardly extending plates attached to said cylindrical portion adjacent said first and second ends respectively.

18. The power striker apparatus of claim 16 further comprising:

said biasing means including a compression spring operably engageable with said base means to urge said base means toward said first position.

* * * * *